United States Patent [19]

Collin

[11] 4,205,980

[45] Jun. 3, 1980

[54] PROCESS FOR REMOVING SULPHUR FROM CRUDE IRON

[75] Inventor: Per H. Collin, Falun, Sweden

[73] Assignee: Stora Kopparbergs Bergslags Aktiebolag, Falun, Sweden

[21] Appl. No.: 899,833

[22] Filed: Apr. 25, 1978

[30] Foreign Application Priority Data

Apr. 27, 1977 [SE] Sweden ..... 7704859

[51] Int. Cl.[2] ..... C21C 7/02

[52] U.S. Cl. ..... 75/53; 75/58; 75/60

[58] Field of Search ..... 75/53, 58, 60

[56] References Cited

U.S. PATENT DOCUMENTS

| | | | |
|---|---|---|---|
| 2,622,977 | 12/1952 | Kalling | 75/58 |
| 3,426,833 | 2/1969 | Randak | 75/58 |
| 3,528,799 | 9/1970 | Ramacciotti | 75/60 |

OTHER PUBLICATIONS

Swift & Wheelock, "Decomposition of Calcium Sulfate in Two Zone Reactor", Ind. Eng. Chem. Process Des. Div., vol. 14, pp. 323-327, (1975).

*Primary Examiner*—P. D. Rosenberg

*Attorney, Agent, or Firm*—Curtis, Morris & Safford

[57] ABSTRACT

A process for removing sulphur from crude iron, comprising:

bringing an adjusted flow of crude iron at a high temperature into contact with CaO by bringing the crude iron to flow through a bed of granules of CaO-containing material of about the same temperature and of such depth that the crude iron leaving the bottom of the bed has the desired low sulphur content, regenerating CaO from CaS formed hereby in the bed by bringing an $O_2$- and/or $SO_2$-containing gas to flow through the bed, and recovering the sulphur and an adjusted fraction of $SO_2$ in the gas flow from the regenerating operation, the residual gas flow being utilized for regeneration as above after introducing necessary oxygen.

4 Claims, 1 Drawing Figure

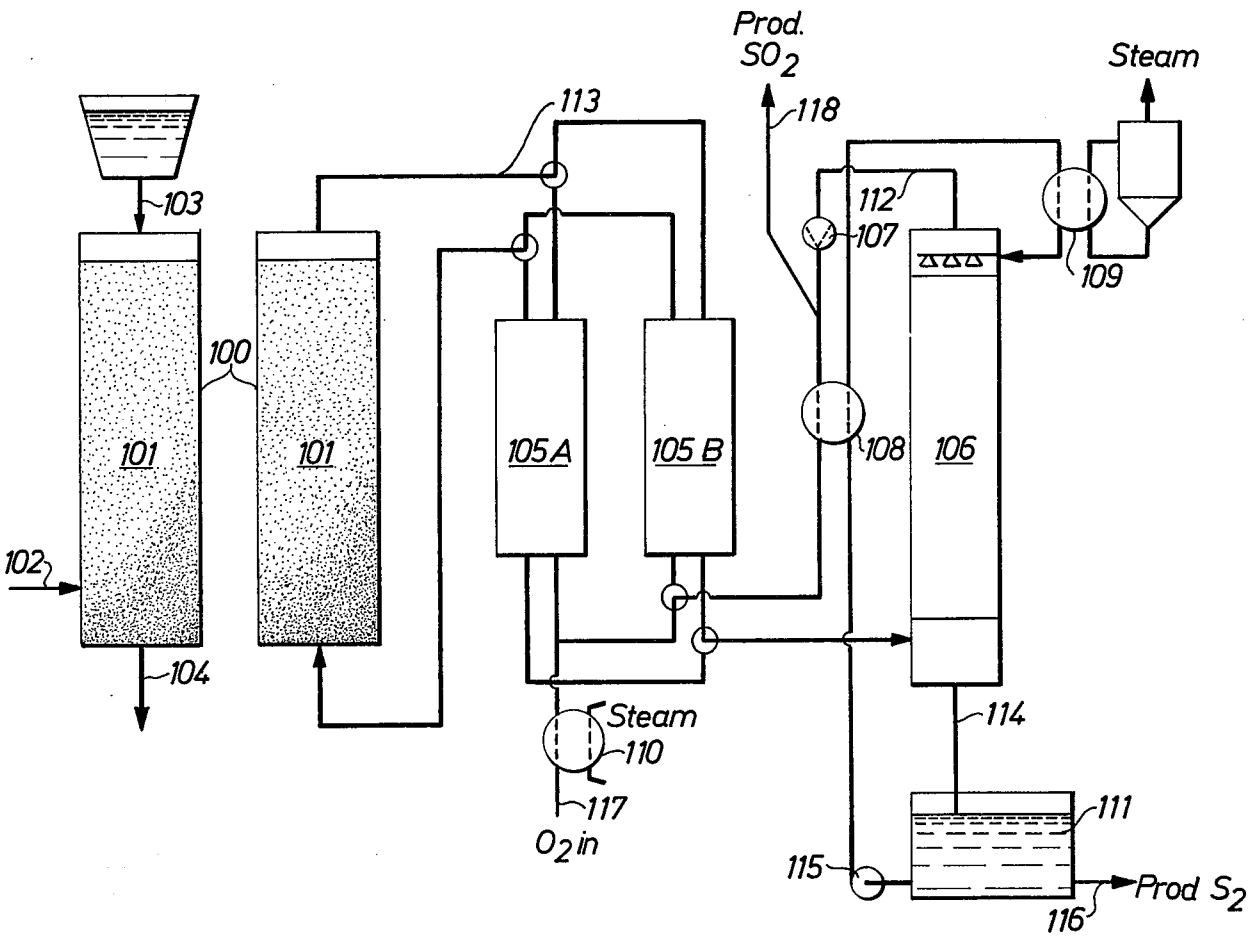
Steam
109
Prod. $SO_2$
118
112
107
108
106
114
111
Prod $S_2$
116
115
113
105 B
105 A
Steam
110
117
$O_2$ in
101
100
101
103
104
102

PROCESS FOR REMOVING SULPHUR FROM CRUDE IRON

The present invention relates to a process for the purification of crude iron with regard to sulphur. The process is particularly advantageous for the purification of crude iron having a high content of sulphur, for example 0.3–1.5% S, and enables the use of carbon with high contents of sulphur in the manufacture of crude iron. Since such carbons relatively speaking become cheaper and cheaper the stronger the requirements are as regards low sulphur contents of the exhaust gases from processes where carbon is used, the process according to the invention involves significant economic advantages.

The process according to the invention has a number of other important advantages as compared to conventional sulphur purification process. Thus, the sulphur extracted from the crude iron is obtained in the form of $SO_2$-gas and liquid elementary sulphur where the molar ratio gas/liquid product can be varied within broad limits (0–20), which enables easy adaption of the actual process to the requirement of the product in question. Moreover, the process of the invention involves a very low consumption of desulphurizing agent since said agent is regenerated and reused.

Desulphurization of crude iron is today mainly performed by means of finely pulverized desulphurizing agents, such as burnt lime, carbide and calcium cyanamide or mixture of two or more of said agents, the agents being injected into the crude iron melt through a tuyere opening at an adapted depth below the surface of the molten crude iron.

In this way the desulphurizing agents are only partly utilized, usually to 20–30%, which results in a considerable consumption and cost per ton of crude iron. The slag formed in such desulphurization is semisolid and agglomerates, which results in significant handling and deposition problems.

The chemical reactions forming the basis for the process of this invention are illustrated on enclosure 1. According to the invention the sulphur of the crude iron is bound as CaS in that the crude iron is brought into contact with CaO-containing materials at a high temperature, suitably 1300°–1700° C. In accordance with the invention such an excess of CaO is hereby used that only a minor part, suitably 10% thereof, reacts with sulphur to form CaS.

The contact between the crude iron and the CaO is in accordance with the invention provided by allowing the crude iron to flow down through a bed of granular CaO-containing material, for example burnt lime or dolomite, the flow of crude iron per unit of cross-sectional area of the bed being adapted so that "flooding" will not arise. The bed shall have such an adapted depth that the crude iron discharged from the bottom thereof at the same rate as supplied to the top thereof is desulphurized to the desired degree. Moreover, the crude iron outlet shall be designed in such a manner that air cannot get access to the bed.

"Flooding" will arise when the liquid flow per unit of cross-section area reaches such a value that the pores between the granules of the bed are filled up with melt. This is not desirable since hereby the desulphurization will be impaired.

In order to obtain a low consumption of lime the CaS formed is, in accordance with the invention, regenerated to CaO, which takes place by bringing CaS into contact with $O_2$- and $SO_2$- -containing gases, preferably a mixture of only $O_2$ and $SO_2$, at a high temperature, suitably 1200°–1600° C. See enclosure 1, reaction 2.

Expelling sulphur bound in the form of CaS by means of an $O_2/SO_2$-mixture results in hot discharge gases from the regenerating operation, said gases, in addition to $SO_2$, containing sulphur vapour ($S_2$). After temperature reduction, suitably by heat exchange, the discharge gases are freed from their content of sulphur vapour in accordance with the invention by condensing said vapour to form liquid sulphur.

Condensed sulphur together with a part of the $SO_2$-gases from the condensation adjusted in accordance with the equations as shown below and are discharged from the regeneration system and utilized for example for manufacture of sulphuric acid and sale of elementary sulphur, respectively. Residual flow of $SO_2$-gases is mixed with an adjusted flow of $O_2$ and recirculated after heating, suitably by heat exchange as indicated above, for regeneration where new quantities of sulphur are expelled. The recirculation is maintained until practically all CaS has been regenerated to CaO, the latter being reused in accordance with the invention for desulphurization of new quantities of crude iron.

Reaction 1, depicted below, is somewhat endothermic, which means that the temperature will decrease somewhat during the desulphurizing operation. By supplying the crude iron at a somewhat higher temperature the desired reaction temperature can be maintained.

Reaction 2 depicted below, is exothermic and the more heat is is liberated the larger the fraction of discharged sulphur is in the form of $SO_2$-gas. Even when discharging only elementary sulphur the heat of reaction is, however, so great that it covers the heat losses of the system, provided that the possibilities of heat exchange within same are utilized.

Since CaS formed in the desulphurizing operation according to the process of this invention will be converted to CaO, only oxygen gas will in principle be consumed. For example, if the regeneration of CaO from CaS is performed at 1400° C. between 0.5 and 1.4 moles of $O_2$ per mole of CaS will be consumed in dependence of the ratio between discharged $SO_2$ and $S_2$. This corresponds to 3.5–0.8 $Nm^3O_2/Fe$ and percent unit of sulphur in the crude iron.

If the crude iron contains silicon (Si) the latter will be consumed before carbon (C) in the desulphurizing operation. The $SiO_2$ hereby formed combines with CaO to form a silicate at the high temperature prevailing during the desulphurizing operation, which results in inactivation of a certain small part of the lime. In order to avoid such inactivation it has therefore been found advantageous in desulphurization in accordance with the invention to remove Si from the crude iron before the desulphurizing operation. In this way the advantage will be obtained that very large quantities of crude iron can be desulphurized before the lime is inactivated by the formation of silicate.

The process of the invention shall now be more closely described with reference to the drawing diagrammatically illustrating an operating example of the invention.

A vertically elongated, lined and well insulated container 100 contains the bed 101 of burnt lime in a granular form necessary for the desulphurizing operation. By means of combustion gases 102 the bed is heated to 1300°–1700° C., an adjusted flow 103 crude iron (2–5%

C) having a temperature of 1300°-1700° C. and being discharged from the bottom of a ladle (=slagfree crude iron) being then, suitably divided up into a number of small part flows, allowed to flow down onto the upper surface of the bed evenly distributed. The flow of crude iron is adjusted in such a manner that "flooding" does not arise in the bed. The crude iron outlet is provided with a lock preventing air from reaching the bed.

When the crude iron flows down through the bed, the granules of which are <25 mm, suitably <10 mm, preferably 7-2 mms, the raw iron is brought into contact with large surfaces of hot CaO. This results in binding the sulphur of the crude iron by reaction with CaO to form CaS, and discharged crude iron 104 is wholly or partly desulphurized depending on the depth of the bed 101. The necessary depth of the bed is dependent on the reactivity of the lime granules and their size.

An adjusted amount of crude iron is brought to flow through the bed 101, in view of which suitably <10%, preferably <5% of CaO in the bed are converted to CaS, container 100 then being connected with the regenerating system consisting of regenerative heat exchangers 105A/B, sulphur condenser 106, fan 107, heat exchangers 108, 109, 110 and sulphur tank 11 having a circulation pump 115.

The discharge gases 112 from the sulphur condenser 106 containing practially only $SO_2$, are transported by fan 107 through a heat exchanger 108, wherein they are heated by circulating liquid sulphur of a relatively high temperature and then mixed with $O_2$ heated by steam in a heat exchanger 110 and supplied 117 into one of the regenerator sections 105A. Herein the gas mixture, which in this example has a molar ratio $O_2/SO_2$ of 0.048, is heated to a high temperature and then transferred to container 100.

In contact with CaS in the lowermost part of the bed 101 sulphide sulphur is burnt by the oxygen gas under the development of heat to form $SO_2$, which results in increased temperature of the gas. The $SO_2$-gas obtained proceeds through the bed, sulphide sulphur being expelled in the form of $S_2$ under consumption of heat. The following formulae illustrate the process at 1400° C.:

| | | H 25° C. kcal |
|---|---|---|
| I | $\frac{1}{3}$ CaS + 0.5 $O_2$ = $\frac{1}{3}$ CaO + $\frac{1}{3}$ $SO_2$ | −37.6 |
| II | $\frac{2}{3}$ CaS + 10.40 $SO_2$ = $\frac{2}{3}$ CaO + $\frac{1}{2}$ $S_2$ + 10.07 $SO_2$ | +10.9 |
| | CaS + 0.5 $O_2$ + 10.40 $SO_2$ = CaO + 10.40 $SO_2$ + 0.5 $S_2$ | −26.7 |

Thus, a gas 113 containing 4.6% sulphur vapour, which is in agreement with the condition of chemical equilibrium at 1400° C., leaves container 100.

The discharged gases 113 are supplied to the second regenerator section 105B, wherein their temperature is reduced to a level suitable for sulphur condensation. The gases are then transferred to condenser 106, suitably designed as a packed column, where the gases, countercurrently, meet liquid sulphur cooled in heat exchangers 108 and 109.

Circulating liquid sulphur together with condensed sulphur are discharged 114 at the bottom of the column and are collected in sulphur tank 111. By pump 115 the flow of sulphur necessary for the condensation circulates through heat exchangers 108 and 109, wherein the sulphur is cooled to a temperature suitable for the condensation. Condensed sulphur corresponding to sulphur extracted from the crude iron and bound in the lime bed 101, is discharged at 116 from sulphur tank 111.

In the specific example described all sulphur in bed 101 will be obtained as elementary sulphur, which is attained by adjusting the $O_2/SO_2$-ratio of the gases to the regenerator section 105 A to 0.048. If this ratio is increased part of the sulphur bound in the bed can be discharged at 118 in the form of $SO_2$-gas after fan 107. If, for example, the ratio $O_2/SO_2$ is increased to 0.213, the sulphur can to 50% be discharged in the form of $SO_2$ and to 50% in the form of elementary sulphur in accordance with the formulae (1400° C.)

| | | H 25° C. kcal |
|---|---|---|
| III | $\frac{2}{3}$ CaS + $O_2$ = $\frac{2}{3}$ CaO + $\frac{2}{3}$ $SO_2$ | −75.2 |
| IV | $\frac{1}{3}$ CaS + 4.70 $SO_2$ = $\frac{1}{3}$ CaO + $\frac{1}{4}$ $S_2$ + 4.53 $SO_2$ | +5.6 |
| | CaS + $O_2$ + 4.70 $SO_2$ = CaO + 4.70 $SO_2$ + 0.25 $S_2$ + 0.5 $SO_2$ | −69.0 |

Comparison between the earlier formulae I and II and III and IV indicates that the gas circulation necessary for expelling the sulphur decreases at increasing molar ratio of $O_2/SO_2$ in the expelling gases which indicates decreasing size of the apparatus for the regenerating system.

If all sulphur extracted from the crude iron can be utilized in the form of sulphuric acid the regenerating system can be simplified. In this case there is suitably used air instead of oxygen gas. The air is preheated in the regenerative heat exchanger and supplied to the lime bed 101. From said bed there leaves a gas having a relatively high $SO_2$-content and a low content of sulphur vapour. The latter is eliminated by the supply of more air, a gas containing $SO_2$ and $O_2$ suitable for the manufacture of sulphuric acid being obtained. In this case the sulphur condenser and its auxiliaries will thus be eliminated, and the heat exchanger can be designed for a lower thermal efficiency in view of the large generation of heat in the lime bed.

1. Desulphurization CaO + FeS + C = CaS + Fe + CO

2. Regeneration $Cas + axO_2 + aSO_2 = CaO + aSO_2 +$ $bS_2 + aySO_2$ → products where $$a = \frac{3p}{3 + 2x(p+1)}$$

$$b = \frac{3(3+2x)}{4(3+2x(p+1)}$$

$$y = \frac{2x(2p-1)-3}{6p}$$

$x \geqq 0$

| p = f(T) | T°C. | 1300 | 1400 | 1500 |
|---|---|---|---|---|
| | p | 37.5 | 16.1 | 9.85 |

What is claimed is:

1. A process for removing sulfur from crude iron, comprising the steps:

(a) maintaining a flow of crude iron through pores formed in a bed of granules and preventing entry of air in said bed, said bed consisting of granules of CaO, said flow being maintained such that the pores between said granules are not substantially entirely filled with crude iron, said iron being at a high temperature of about 1300°–1700° C., said bed of granules being at or about the same temperature as said iron and of such depth that the crude iron leaving the bottom of the bed has the desired low sulphur content, while utilizing at most 10% of the CaO in said bed by conversion to CaS, (b) regenerating CaO, from CaS formed in the bed, by reacting CaS with an $O_2$- and/or $SO_2$-containing gas, at high temperature, by causing said gas to flow through the bed, and (c) recovering the sulphur and a fraction of $SO_2$ in the gas flow from said regenerating of CaO, the residual gas flow being utilized for regeneration as under step (b) above, after introducing a sufficient amount of $O_2$ therefor.

2. A process according to claim 1, wherein the Si-content of the crude iron is removed before the contact with the granules.

3. A process according to claim 1 or 2, wherein slag is prevented from being entrained in the flow of crude iron.

4. A process according to claim 1, comprising utilizing all sulphur bound in CaS for the preparation of $H_2SO_4$ in that formed CaS in converted to CaO with preheated air, burning the sulphur of the gases leaving the regeneration operation by further supply of air to form a mixture of air and $SO_2$ and recovering $SO_2$ suitable for the manufacture of sulphuric acid.

* * * * *